US006672848B2

(12) United States Patent
Yang

(10) Patent No.: US 6,672,848 B2
(45) Date of Patent: Jan. 6, 2004

(54) CRUCIFORM PUMP

(76) Inventor: Gene-Huang Yang, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/100,292

(22) Filed: Mar. 19, 2002

(65) Prior Publication Data

US 2003/0180166 A1 Sep. 25, 2003

(51) Int. Cl.[7] ..... F04B 19/02
(52) U.S. Cl. ..... 417/462; 417/465
(58) Field of Search ..... 417/462, 465, 417/460, 273

(56) References Cited

U.S. PATENT DOCUMENTS 1,539,587 A * 5/1925 Mocigemba ..... 417/462
1,853,394 A * 4/1932 Appel ..... 417/462
4,936,111 A * 6/1990 Wilkinson et al. ..... 62/504
6,179,583 B1 * 1/2001 Weston ..... 417/392

* cited by examiner

*Primary Examiner*—Cheryl J. Tyler
*Assistant Examiner*—Michael K. Gray

(57) ABSTRACT

A cruciform pump comprises a casing, a positioning round disk in the casing; a driven rotary disk; and two sliding blocks. A center of the positioning round disk is arranged corresponding to a center of the casing, and has a cruciform sliding groove. The driven rotary disk is eccentrically installed on the positioning round disk. One rotary shaft at one surface of the rotary disk protrudes out of the casing. The two sliding blocks are installed in the cruciform sliding groove. Each block is conformed to the sliding groove, so that the positioning round disk is driven by the sliding blocks. When the driven rotary disk rotates through two circles, the positioning round disk only rotates through one circle. During rotation, the two sliding blocks move along the cruciform sliding groove; then, one side of the sliding block presses fluid flowing out, and another side thereof will suck fluid into the sliding groove.

9 Claims, 7 Drawing Sheets

CRUCIFORM PUMP

FIELD OF THE INVENTION

The present invention relates to pumps, and particularly to a cruciform pump.

BACKGROUND OF THE INVENTION

The most frequently used pumps include gear pumps, reciprocal pumps, and eccentric pumps. The manufacturing process of gear pumps is complicated and turbulent flow and dead locking are easily generated in the transferring process. The reciprocal pumps can not operate continuously and have larger noises. The eccentric pumps can not achieve the object of transferring in high pressure. Therefore, the prior art pumps have many defects which are necessary to be improved.

SUMMARY OF THE INVENTION

Accordingly, the primary object of the present invention is to provide a cruciform pump which can resolve the above problems by matching the circular and straight movements. Thereby, the manufacturing cost is reduced and the transferring efficiency is improved.

To achieve above object, the present invention provides a cruciform pump comprising a casing, a positioning round disk in the casing; a driven rotary disk; and two sliding blocks. A center of the positioning round disk is arranged corresponding to a center of the casing, and has a cruciform sliding groove. The driven rotary disk is eccentrically installed on the positioning round disk. One rotary shaft at one surface of the rotary disk protrudes out of the casing. The two sliding blocks are installed in the cruciform sliding groove. Each block is conformed to the sliding groove, so that the driven rotary disk is driven by power outside the pump. When the driven rotary disk rotates through two circles, the positioning round disk only rotates through one circle. During rotation, the two sliding blocks move along the cruciform sliding groove; then, one side of each sliding block presses fluid flowing out, and another side thereof will suck fluid into the sliding groove.

The various objects and advantages of the present invention will be more readily understood from the following detailed description when read in conjunction with the appended drawing.

DETAILED DESCRIPTION OF THE PREFERRED EMBODIMENTS

Figure 1:
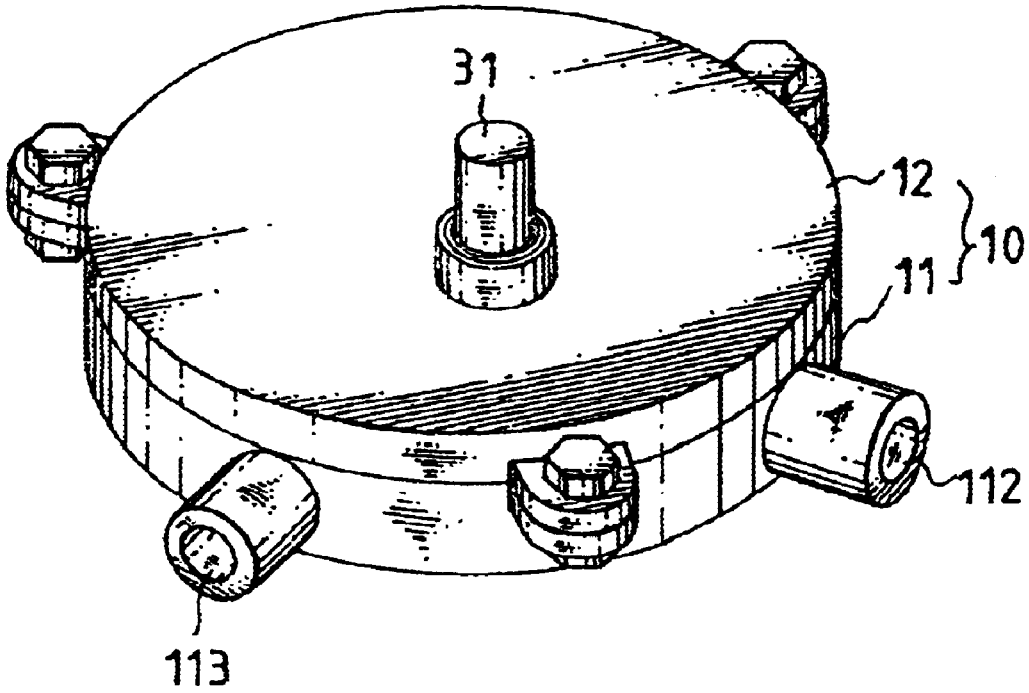
FIG. 1 shows a schematic view of the present invention.
Figure 2:
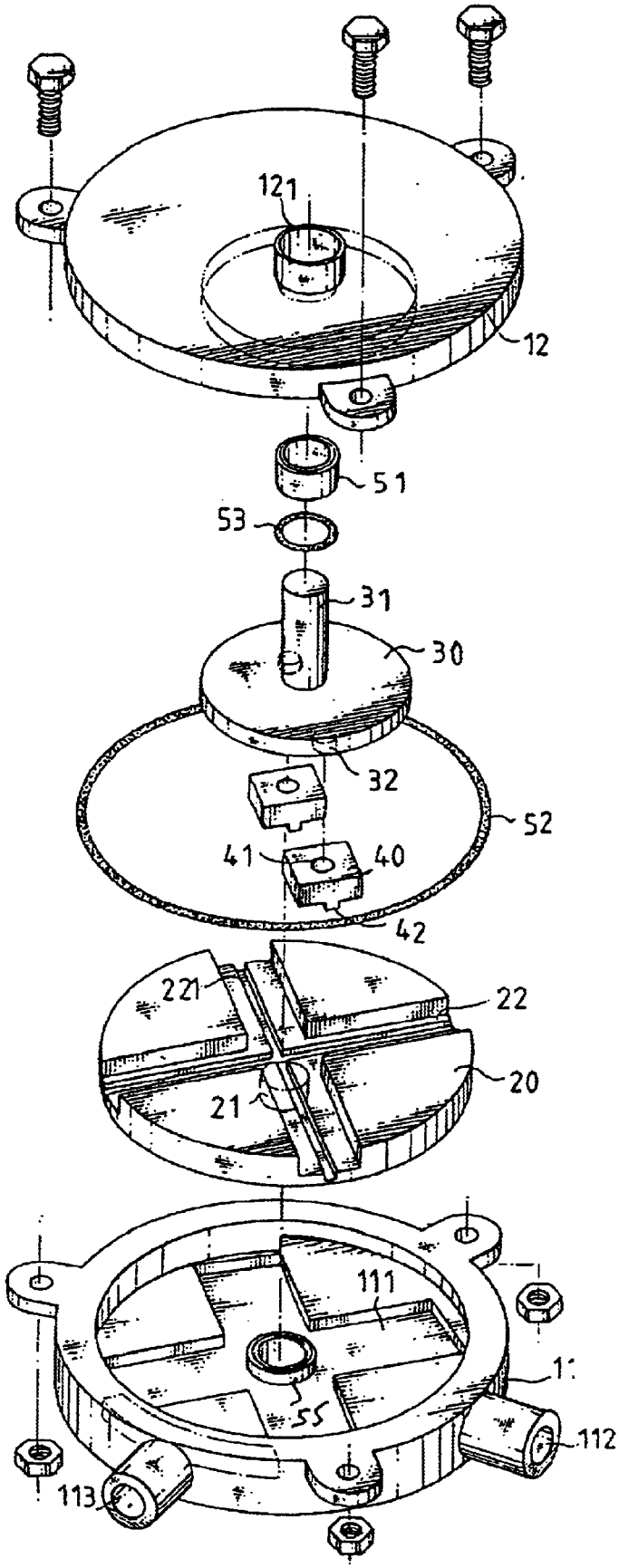
FIG. 2 shows an exploded schematic view of the present invention.
Figure 3:
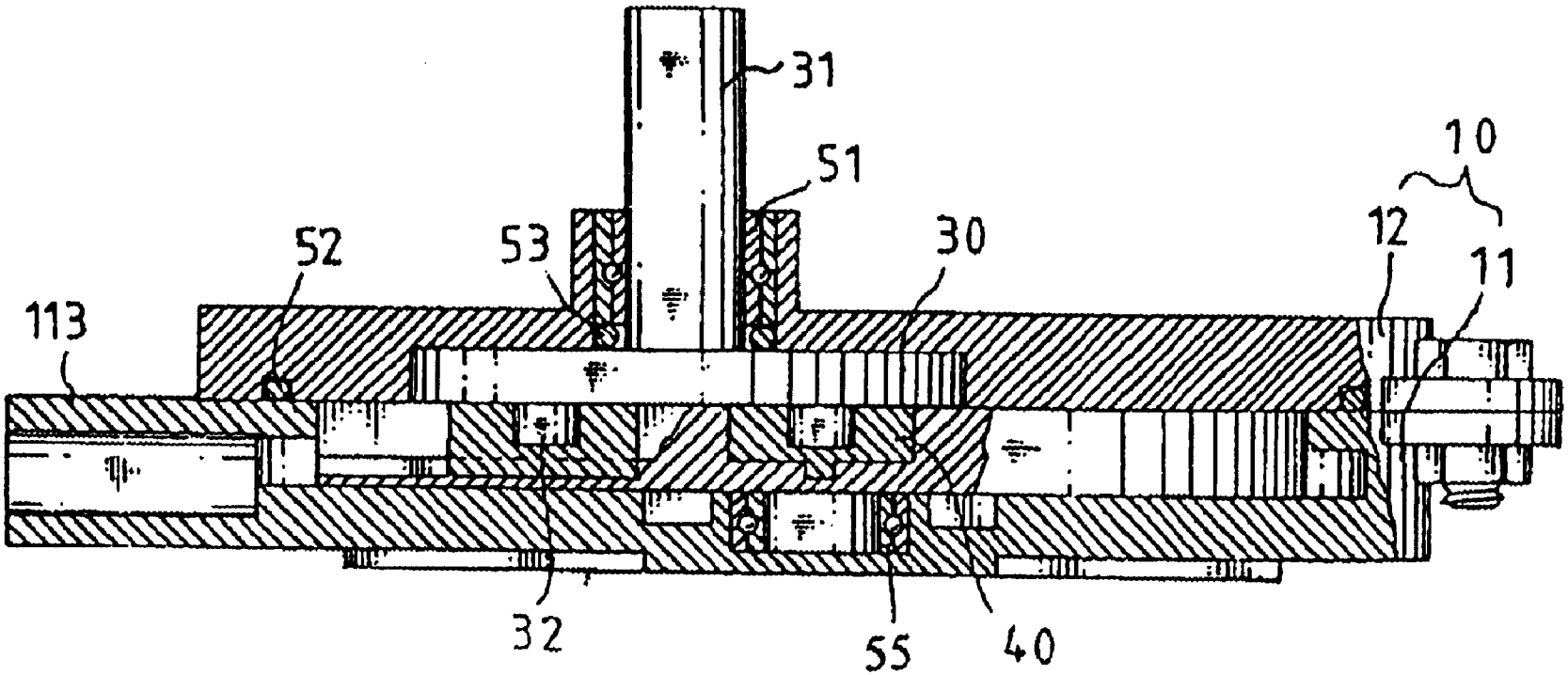
FIG. 3 shows a cross sectional view of the present invention.
Figure 4:
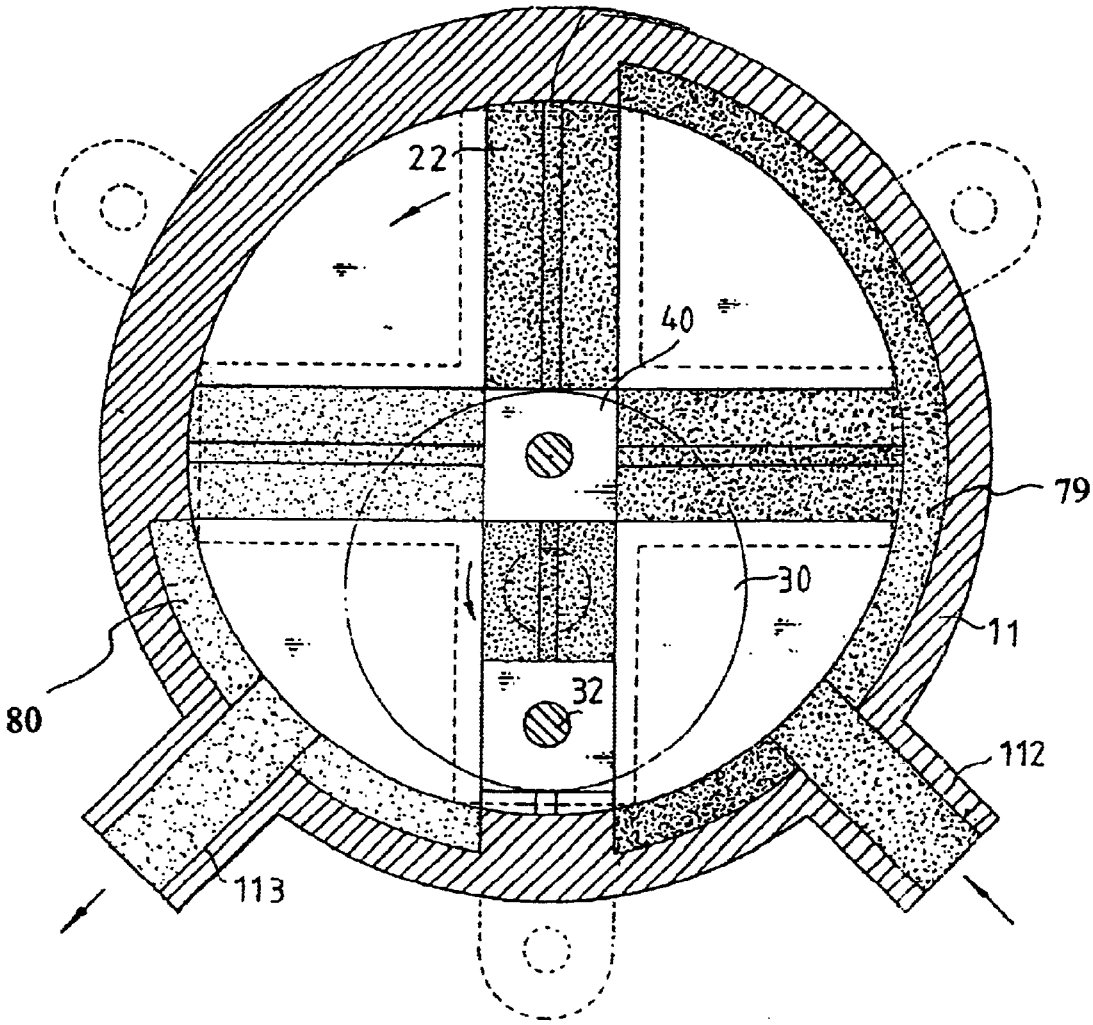
FIG. 4 is a schematic view showing a first step of the operation of the present invention.
Figure 5:
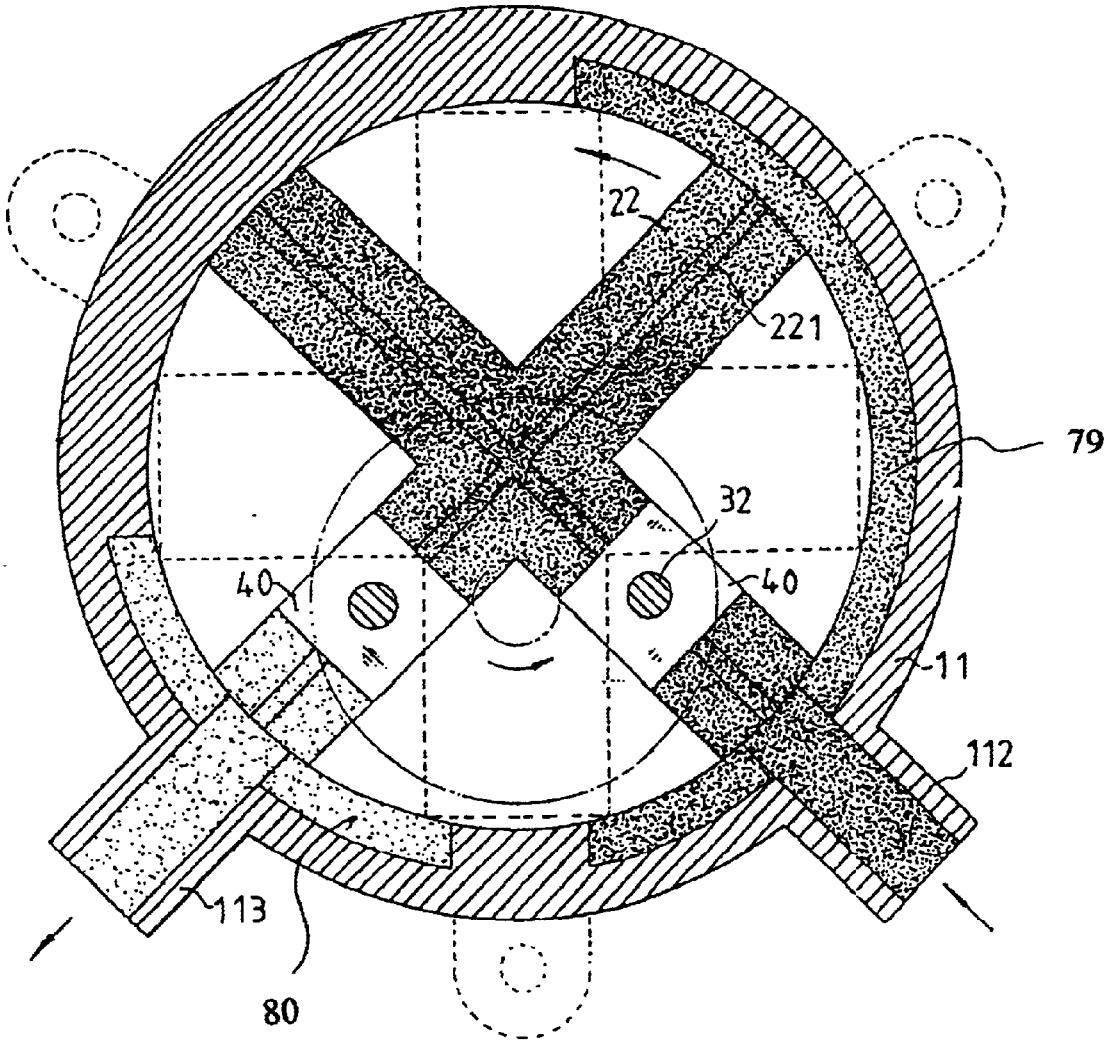
FIG. 5 is a schematic view showing a second step of the operation of the present invention.
Figure 6:
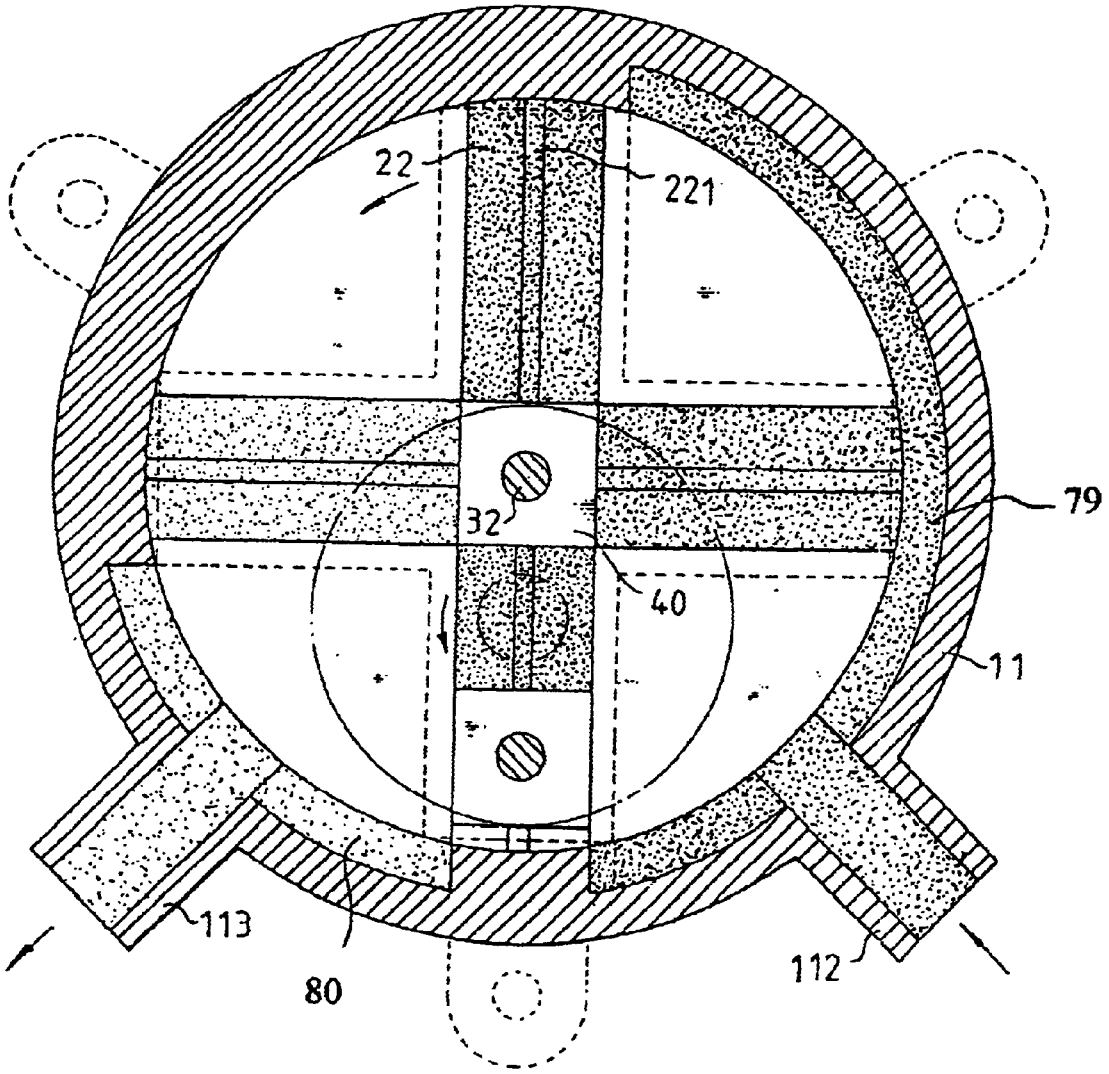
FIG. 6 is a schematic view showing a third step of the operation of the present invention.
Figure 7:
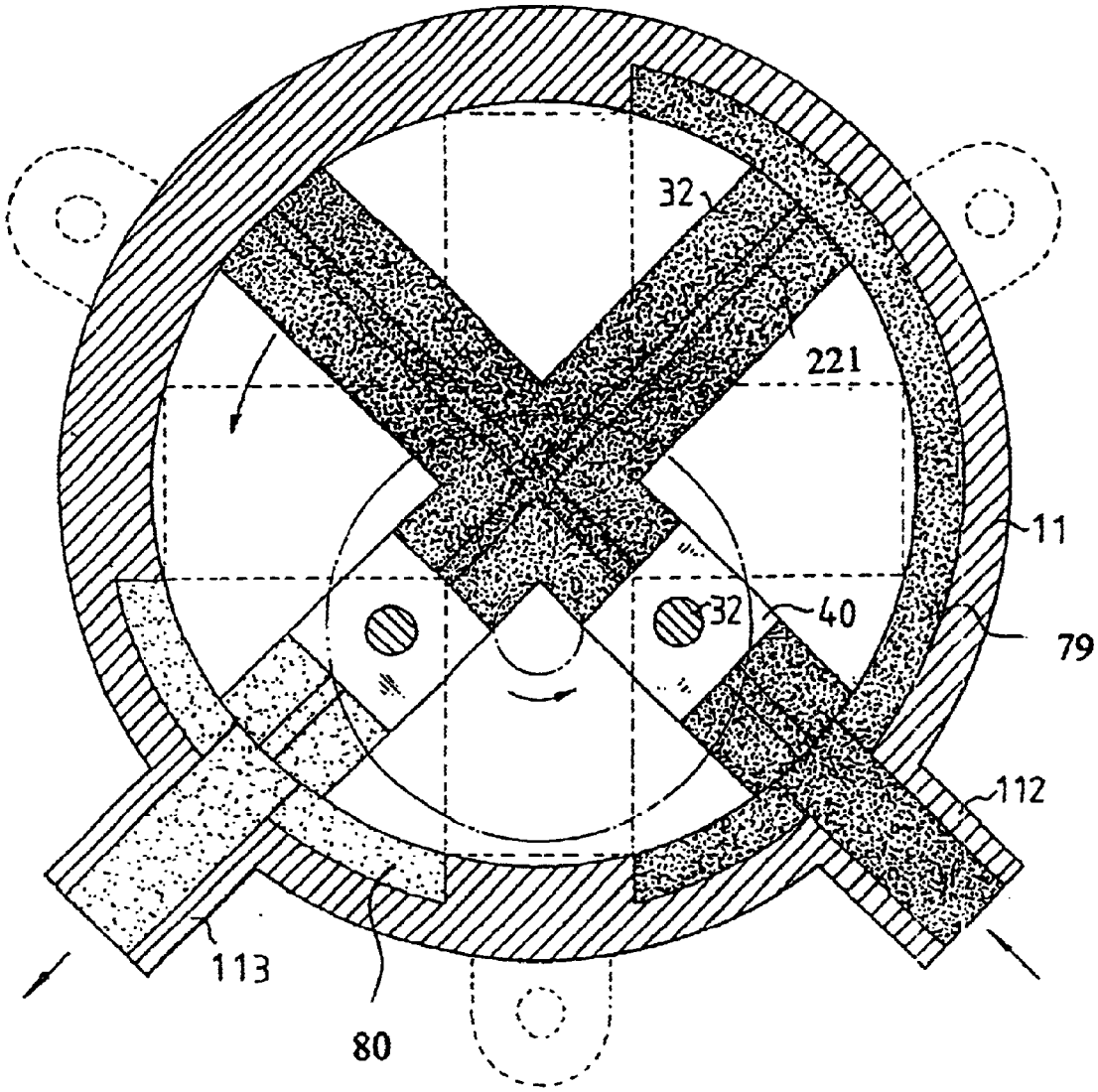
FIG. 7 is a schematic view showing a fourth step of the operation of the present invention.

Referring to FIGS. 1 to 3, the cruciform pump of the present invention is illustrated. The cruciform pump comprises a casing 10, a positioning round disk 20, a driven rotary disk 30, and two sliding blocks 40.

The casing 10 is formed by a seat 11, and a top cover 12. The seat 11 is a round disk and an inner edge thereof has a receiving space 111. A bearing is engaged at a center of the receiving space 111 for installing a positioning round disk 20. The periphery of the casing has an inlet 112 and an outlet 113. The top cover 12 is also a round disk and is installed above the seat 11. The top cover 12 has a penetrated eccentric hole 121. The eccentric hole 121 is installed with a bearing 51 and a smaller rubber ring 53. A larger annular rubber ring 52 is installed between the seat 11 and the top cover 12 for preventing fluid from draining out.

The positioning round disk 20 is slightly smaller than the round disk of the seat 11 and is placed in the receiving space 111. One surface thereof is protruded with a positioning post 21, and another surface is installed with a cruciform sliding groove 22, and the bottom of the sliding groove 22 has a cruciform guide groove 221. The lower edge of the sliding block 42 can be coupled with the guide groove 221. Two sliding blocks 40 can be placed in the sliding groove 22. The positioning post 21 is inserted into bearing 55 at the bottom of the seat 11.

The driven rotary disk 30 is a round disk. One surface thereof is a rotary shaft 31 and another surface has two positioning rods 32. The rotary shaft 31 is parallel to axial centers of the casing 10 and the positioning round disk 20 and is eccentric. Thereby, the rotary shaft 31 exactly passes through the eccentric hole 121 of the top cover 12 and thus protrudes out. The two positioning rods 32 are used for connecting the two sliding blocks 40. The half of the distance between the centers of the two positioning rods 32 is equal to the distance between the axial centers of the rotary shaft 31 and the positioning round disk 20.

The two sliding blocks 40 are rectangular blocks and are installed on the predetermined positions in the sliding groove 22. Each sliding block 40 has a positioning hole 41 thereon for being inserted by the positioning rod 32 of the rotary disk 30. The two sliding blocks 40 can be driven by the driven rotary disk 30. The lower surface of the sliding blocks 40 is protruded with a guide unit 42. When the two sliding blocks 40 are installed in the sliding groove 22, the guide units 42 can be placed in the guide groove 221. Thereby, the two sliding blocks 40 move steadily and tightly coupled in the groove.

Thereby, by above components, when power is input from the rotary shaft 31 of the driven rotary disk 30, the two positioning rods 32 will drive the sliding blocks 40 to slide within the sliding groove 22. Meanwhile, the positioning round disk 20 will also rotate therewith. When the driven rotary disk 30 rotates through two circles, the positioning round disk 20 only rotates through one circle. During rotation, the two sliding blocks 40 move along the cruciform sliding groove 22 (referring to FIGS. 4 to 7). Then, one side of each sliding block 40 presses fluid flowing out, and another side thereof will suck fluid into the sliding groove 22.

To be more clearly, in the operation illustrated in FIGS. 4 to 7, the side of the inlet 112 illustrated by dark dashed lines in the inlet channel 79 represents that the input fluid is not pressed, while the side at the outlet 113 illustrated by light dashed lines in the outlet channel 80 represents fluid is being pressed by sliding block 40. The seat 11 and the positioning round disk 20 from an inlet channel 79 and an outlet channel 80. The inlet channel is connected to the inlet 1.12 and the outlet channel is connected to the outlet 113. The inlet channel and the outlet channel are fluids isolated from one another.

The cruciform pump is suitable for pumping a fluid from one of a gas and liquid or from pumping a fluid containing gas and liquid.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A cruciform pump comprising a casing having and inlet and outlet, a position round disk in the casing; a driven rotary disk; and two sliding blocks; the positioning round disk having a cruciform sliding groove and a center of the positioning round disk being arranged to correspond to the center of the casing; the driven rotary disk being eccentrically installed on the positioning round disk; a shaft protruding from one surface of the rotary disk extends out of the casing; the two sliding blocks being connected to another surface of the rotary disk so as facilitate rotation of the positioning round disk; wherein when the driven rotary disk completes two circular rotations, the positioning round disk completes only one circular rotation, when the rotary disk and round disk rotate, the movement of the sliding blocks causes fluid to be sucked from the inlet into the sliding groove and then discharged from the sliding groove through the outlet.

2. The cruciform pump as claimed in claim 1, wherein a bottom of the cruciform sliding groove is formed with a cruciform guide groove; a lower surface of each of the two sliding blocks is protruded with a guide unit; when the two sliding blocks are installed in the sliding groove, the guide units are placed in the guide groove, thereby, the two sliding blocks move steadily and are tightly coupled in the groove.

3. The cruciform pump as claimed in claim 1, wherein the cruciform pump is suitable for pumping fluid being selected from one of a gas and liquid.

4. The cruciform pump as claimed in claim 1, wherein as the positioning round disk rotates one side of each sliding block causes fluid to be pressed out of the sliding groove and another side of each sliding block causes fluid to be sucked into the sliding groove.

5. A cruciform pump comprises a casing, a positioning round disk, a driven rotary disk, and two sliding blocks; wherein the casing is formed by a seat and a top cover; the seat is a round disk and an inner edge thereof has a receiving space; a bearing is engaged at a center of the receiving space for installing a positioning round disk; a periphery of the casing has an inlet and an outlet; a top cover is installed above the seat and has a penetrated eccentric hole; the positioning round disk is placed in the receiving space; one surface thereof is protruded with a positioning post, and another surface is installed with a cruciform sliding groove, the positioning post is exactly inserted into the bearing; two sliding blocks are installed in the sliding groove;

the driven rotary disk is a round disk; one surface thereof has a rotary shaft and another surface has two positioning rods, a half a distance between centers of the two positioning rods is equal to a distance between an axial centers of the rotary shaft and the positioning round disk; the rotary shaft is eccentric and parallel to the axial centers of the casing and the positioning round disk; thereby the rotary shaft exactly passes through the eccentric hole of the top cover and thus is protruded out and the two positioning rods are used for connecting the two sliding blocks; the two sliding blocks are positioned in the sliding groove; each sliding block has a positioning hole thereon for being inserted by the positioning rod of the rotary disk; thereby, the two sliding blocks are driving by the driven rotary disk;

wherein when the driven rotary disk completes two circular rotations, the positioning round disk completes only one circular rotation, and when the rotary disk and round disk rotate, the movement of the sliding blocks causes fluid to be sucked from the inlet into the sliding groove and then discharged from the sliding groove through the outlet.

6. The cruciform pump as claimed in claim 5, wherein a bottom of the cruciform sliding groove is formed with a cruciform guide groove; a lower surface of each of the two sliding blocks is protruded with a guide unit; when the two sliding blocks are installed in the sliding groove, the guide units are placed in the guide groove, thereby, the two sliding blocks move steadily and are tightly coupled in the groove.

7. The cruciform pump as claimed in claim 5, wherein the cruciform pump is suitable for pumping fluid being selected from one group containing gas and liquid.

8. The cruciform pump as claimed in claim 5, wherein as the positioning round disk rotates, one side of each sliding block causes fluid to be pressed out of the sliding groove and another side of each sliding block causes fluid to be sucked into the sliding groove.

9. The cruciform pump as claimed in claim 5, wherein the seat and the positioning round disk form an inlet channel and an outlet channel, the inlet channel is connected to the inlet and the outlet channel is connected to the outlet, with the inlet and outlet channels being isolated from one another.

* * * * *